US006397507B1

(12) United States Patent
Marshall et al.

(10) Patent No.: US 6,397,507 B1
(45) Date of Patent: Jun. 4, 2002

(54) METHOD AND APPARATUS FOR A HAND-GRIPABLE BIOMECHANICAL TOOL

(75) Inventors: Forrest Alan Marshall; Steven Brian Knight, both of Dublin, GA (US)

(73) Assignee: Marshall Research, LLC, Dublin, GA (US)

( * ) Notice: Subject to any disclaimer, the term of this patent is extended or adjusted under 35 U.S.C. 154(b) by 0 days.

(21) Appl. No.: 09/644,015

(22) Filed: Aug. 22, 2000

(51) Int. Cl.[7] ..... F41C 23/00

(52) U.S. Cl. ..... 42/72; 42/73; 42/90; 42/94; 42/106

(58) Field of Search ..... 42/90, 94, 73, 42/72

(56) References Cited

U.S. PATENT DOCUMENTS

| | | | | | |
|---|---|---|---|---|---|
| 879,052 | A | | 2/1908 | Jeranek | |
| 2,386,802 | A | | 10/1945 | Johnson | 42/94 |
| 2,472,804 | A | * | 6/1949 | Bird | 89/1.7 |
| 2,771,697 | A | | 11/1956 | Reising | 42/71 |
| 2,826,848 | A | | 3/1958 | Davies | 42/71 |
| 2,844,905 | A | | 7/1958 | Musser | 42/94 |
| 3,225,656 | A | * | 12/1965 | Flaherty et al. | 89/37 |
| 4,026,057 | A | * | 5/1977 | Cady | 42/94 |
| 4,502,238 | A | * | 3/1985 | Farrar et al. | 42/72 |
| 5,345,706 | A | * | 9/1994 | Brown | 42/94 |
| 5,414,949 | A | * | 5/1995 | Peebles | 42/94 |
| 5,819,463 | A | | 10/1998 | Amos | 42/94 |
| 5,903,995 | A | | 5/1999 | Brubach | 42/94 |
| 5,946,842 | A | | 9/1999 | Nyzell | 42/72 |

* cited by examiner

*Primary Examiner*—Michael J. Carone
*Assistant Examiner*—John Richardson
(74) *Attorney, Agent, or Firm*—Patent Focus, Inc.; Richard C. McComas

(57) ABSTRACT

An apparatus for a firearm, the firearm having a user hand-gripable barrel portion. The apparatus has a U-shaped member with an outwardly extending cylindrical protuberance swivelably disposed thereto. An elongated handle is detachably secured to the cylindrical protuberance. An elevated contoured member is mountably disposed along the curved portion of the U-shaped member. The elevated contoured member is formed to receive a selected portion of the hand-gripable barrel of the firearm. An elongated strap is connectively disposed to the U-shaped member. The elongated strap traverses the hand-gripable barrel portion of the firearm thereby detachably securing the firearm to the U-shaped member. Whereby the user gripping the elongated handle enables swivelable firearm movement.

12 Claims, 3 Drawing Sheets

10
11
12
14
15
16
20
23
29
30
41
42
43
44
46
47
48
50
51
52
53
54

METHOD AND APPARATUS FOR A HAND-GRIPABLE BIOMECHANICAL TOOL

FIELD OF THE INVENTION

The invention relates, in general, to a hand gripable biomechanical tool. In particular, the invention relates to an apparatus mounted to a firearm stock containing a portion of the firearm's barrel. More particularly the invention relates to a swivelable hand gripable apparatus mounted to a firearm stock containing a portion of the firearm's barrel. A user of the swivelable apparatus is enabled to pivot the firearm while aiming the firearm.

BACKGROUND OF THE INVENTION

Firearms are manufactured in various sizes, calibers, and physical configurations. In general, firearms used by sportsmen are pistols, rifles, or shotguns. The sportsman may engage in game hunting or target shooting i.e., stationary or moving targets. Sportsmen, regardless of the type of firearm they use or the sport they are engaged in, have one common thread that runs through the connection between the sportsman and his firearm. The common thread is aiming the firearm before discharging the weapon.

The standard or common practice for aiming a firearm, a rifle for example, is to place the rifle stock butt against either the right or left shoulder and grip a portion of the stock containing the firing mechanism with either the right or left hand. The sportsman's other hand is positioned palm up along a portion of the stock containing the barrel of the rifle. The rifle is cradled in a position allowing the sportsman to raise the rifle and align the sights of the rifle with the intended target thus aiming the firearm at the target.

The palm of the hand facing upwards and grasping the stock portion containing the barrel causes the muscles in the forearm to tighten thus supporting the wrist and hand. The thumb and forefinger form a U-shaped cradle for the barrel-mounted stock. The remaining fingers of the hand provide no mechanical advantage in supporting the firearm. Various muscle groups of the shoulder, upper arm, forearm, and hand are tightened to support the firearm while the sportsman is aiming the firearm.

The tightening of the aforementioned muscle groups restricts the arcuate movement of the firearm while aiming. The arcuate movement required during aiming of the firearm or tracking a moving target while aiming the firearm is limited to a relatively short arcuate radius extending to either side of the centerline of the barrel of the firearm. If further arcuate movement is desired, the sportsman must traverse his upper torso in concert with his arm movement. The extended arc produced by the upper torso and arm movement only marginally extend the radius of the arc. If further extensions in the radius of the arc are desired the sportsman must physically change or move his stance i.e., his whole body relative to the target. The change of stance while aiming a firearm may be acceptable during target shooting but changing stance while game hunting may cause the game to bolt. The sportsman would be required to re-aim the firearm and possibly change his stance once again.

Attempts in the past to provide mechanical advantage to a firearm to increase the successful aiming of the firearm have been concerned with the vertical or horizontal position of the barrel relative to the target. One attempt is disclosed in U.S. Pat. No. 2,826,848 issued to T. E. Davis on Mar. 18, 1958. The Davis patent discloses a hand held elongated apparatus that has one end formed into a C-shape. The C-shaped end fits partially about the barrel of a firearm. A sportsman grasps the elongated portion and aims the firearm. The sportsman may, if desired, increase the elevation of the barrel by partially unscrewing the C-shaped end from the elongated apparatus. The Davis patent discloses an apparatus to increase the user's ability to obtain a constant firearm barrel elevation but does not teach a method or apparatus to increase the sportsman's arcuate movement of a firearm while aiming at a moving target.

Another attempt to remedy the problems of aiming a firearm at a moving target are disclosed in U.S. Pat. No. 879,052 issued to J. Jeranek on Feb. 11, 1908. The Jeranek patent discloses an elongated apparatus that has one end sharpened to assist in penetrating a surface or penetrating the ground to provide a stationary position for the elongated apparatus. The elongated apparatus has a sliding tubular section that may, if desired, be adjustably secured to select a desired elevation of the firearm. The elongated apparatus has a U-shaped member mounted at one end of the tubular section. The U-shaped member is rotatably mounted to the tubular section. The firearm is positioned within the confines of the U-shaped member and aimed by the sportsman. Presumably, if the sportsman desired to track a moving target he would rotate the U-shaped member by moving his body about the elongated apparatus.

It would be desirable to have an apparatus that enables a sportsman to aim a firearm utilizing a maximum arcuate radius to achieve maximum arcuate movement of the barrel while aiming the firearm. The apparatus would be biomechanical thereby enabling the sportsman to grasp the stock mounted barrel with either the right or left hand utilizing all of his fingers of the right or left hand. The palm holding the apparatus would be in a neutral position rather than a supinated position i.e., the palm facing upwards. The neutral position of the palm about the apparatus would provide stabilization from both the pronator teres as well as the supinator for improved elbow stabilization. The brachioradialis is at a mechanical advantage to aid in strength and stabilization of the elbow flexors with the palm in the neutral position. The shoulder is adjusted from the conventional external rotation to an increased internal rotation, allowing both the long and short head of the bicep to aid in shoulder flexion and stabilization. With the improved gripping of the finger flexors about the apparatus there would be an improved ability to stabilize the butt of the firearm into the shoulder of the sportsman. The desirable results of grasping an apparatus in the above discussed manner would enable the sportsman to biomechanically enhance the stability, mobility, comfort, and accuracy while engaged in target shooting or game hunting.

SUMMARY OF THE INVENTION

The present invention is a user operable and hand gripable tool or apparatus that incorporates biomechanical features enabling a user to aim a firearm. The present invention may be mounted on any barrel of any type of firearm. If desired, the present invention may be mounted to the firearm stock containing the portion of the firearm's barrel. The user of the present invention is enabled to aim the firearm utilizing the maximum arcuate radius derived from the pivotal movement of the firearm while aiming or tracking an intended target.

The present invention is a biomechanical apparatus for a firearm wherein the firearm has a user hand-gripable barrel portion. The apparatus may, if desired, comprise a U-shaped member that has an outwardly extending cylindrical protuberance. The outwardly extending cylindrical protuberance is swivelably mounted to the U-shaped member. An elevated contoured member is connected along the curved portion of the U-shaped member. The elevated contoured member is sized to receive a selected portion of the user hand-gripable barrel portion of the firearm. An elongated handle has an aperture disposed in one end. The aperture is sized to receive a portion of the outwardly extending cylindrical protuberance. The elongated handle is detachably secured to the U-shaped member by a setscrew that adjoins the elongated handle and the outwardly extending cylindrical protuberance. The U-shaped member is now free to rotate 360° (degrees) about one end of the elongated handle.

The present invention may, if desired, have an elongated connecting strap traversing the barrel or the barrel mount stock portion of the firearm and the U-shaped member. The elongated connecting strap may, if desired, be detachably securable to the barrel and the U-shaped member by a hook and loop fastener. The present invention may further have a pair of pads mounted onto the legs of the U-shaped member thus protecting the barrel or stock mount barrel from damage. The pads may be of any size or material composition and may serve as supporting ballast for varying sizes of barrels or stock mounted barrels.

A user of the present invention, once the apparatus was mounted to a firearm, would grip the elongated handle with either the right or left hand. The user's other hand would be in proximity to the trigger mechanism. The butt of the firearm would be against the user's shoulder. The firearm would be raised or positioned in the general direction of a selected target. If the target was moving the user would, if desired, aim the firearm by arcuately traversing the barrel of the firearm using the elongated handle. The stock of the firearm would pivot against the user's shoulder thereby enabling arcuate movement of the barrel while the elongated handle remained stationary in the user's hand as the barrel portion connected to the U-shaped member swiveled relative to the handle. The swivel action of the present invention provides maximum arcuate movement of the barrel of the firearm during the aiming process discussed herein.

When taken in conjunction with the accompanying drawings and the appended claims, other features and advantages of the present invention become apparent upon reading the following detailed description of embodiments of the invention.

BRIEF DESCRIPTION OF THE DRAWINGS

The invention is illustrated in the drawings in which like reference characters designate the same or similar parts throughout the figures of which.

DETAILED DESCRIPTION OF THE PREFERRED EMBODIMENT OF THE PRESENT INVENTION

Figure 1:
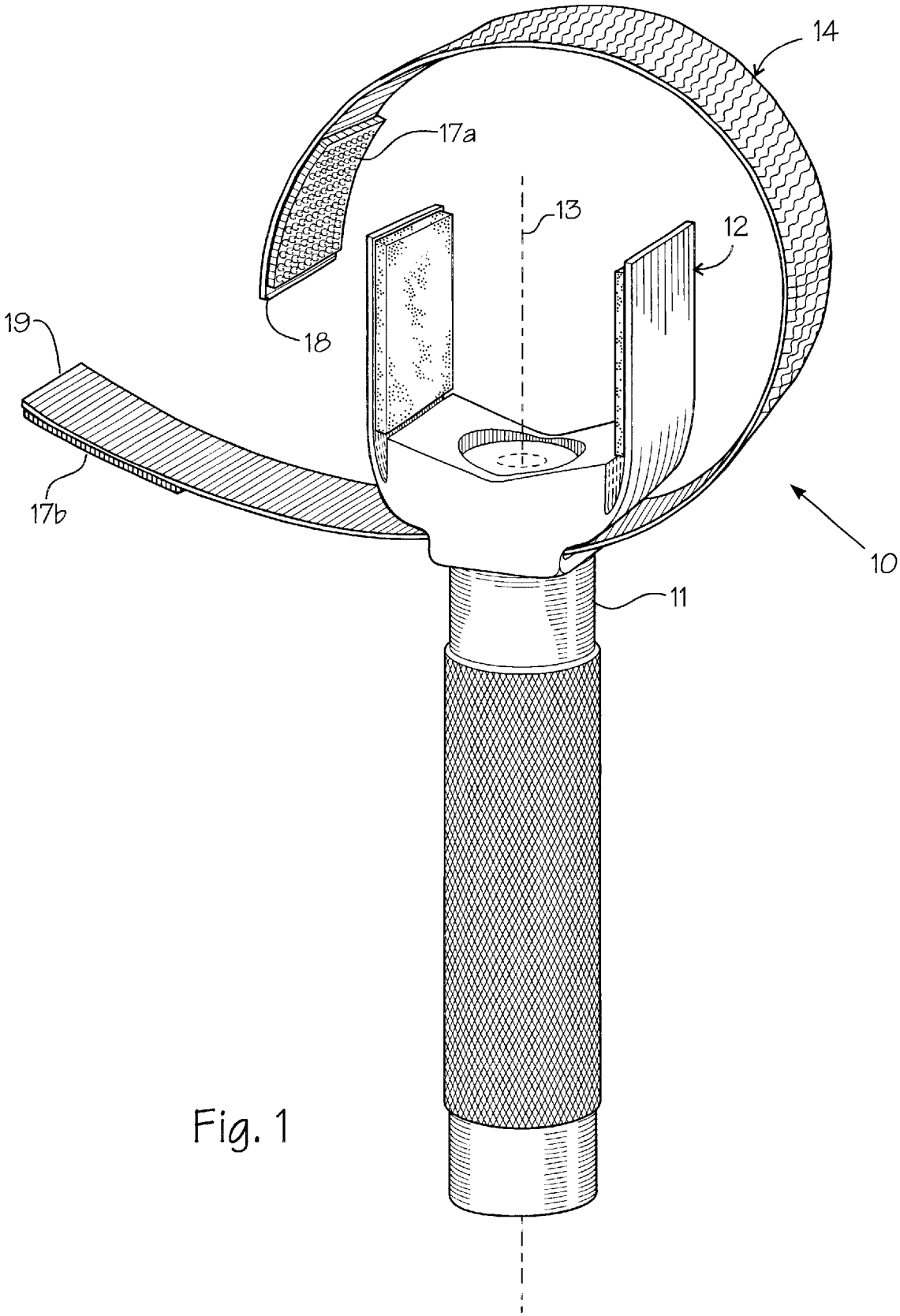
FIG. 1 illustrates a perspective view of the preferred embodiment of the present invention.
Figures 3, 4, 5, 6, 7:
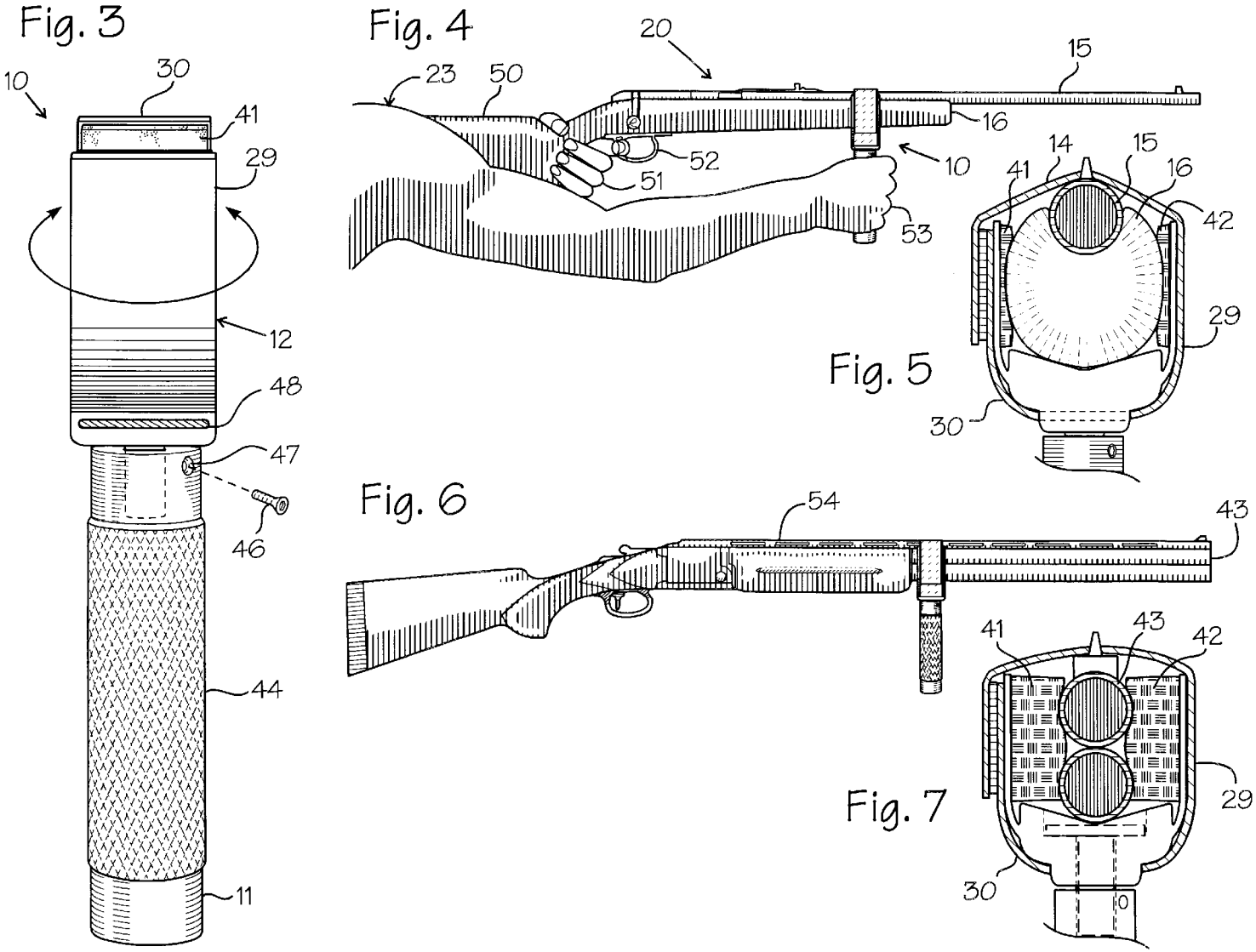
FIG. 3 illustrates a side view of the present invention.
FIG. 4 illustrates a side view of the present invention mounted on a single barrel firearm.
FIG. 5 illustrates an end view of FIG. 4.
FIG. 6 illustrates a side view of the present invention mounted on to a double barrel firearm.
FIG. 7 illustrates an end view of FIG. 6.

The present invention 10, FIG. 1 is a user operable and hand gripable tool or apparatus incorporating biomechanical features to enable a user to aim a firearm 20, FIG. 4. The present invention 10, FIG. 4 may be mountable to any barrel 15 of any type of firearm 20. The present invention 10, FIG. 1 has a U-shaped member 12 mounted to an elongated handle 11. The U-shaped member swivels 360° (degrees) about the centerline 13 of the elongated handle 11. A flexible strap 14 may, if desired, be provided to retain the barrel 15 mounted stock 16, FIG. 5. The strap 14, FIG. 1 has hook 17*a* and loop 17*b* fastener connected respectively to ends 18 and 19. Once the hook 17*a* and loop fastener 17*b* are engaged, they detachably secure the firearm 20 to the present invention 10.

Figure 2:
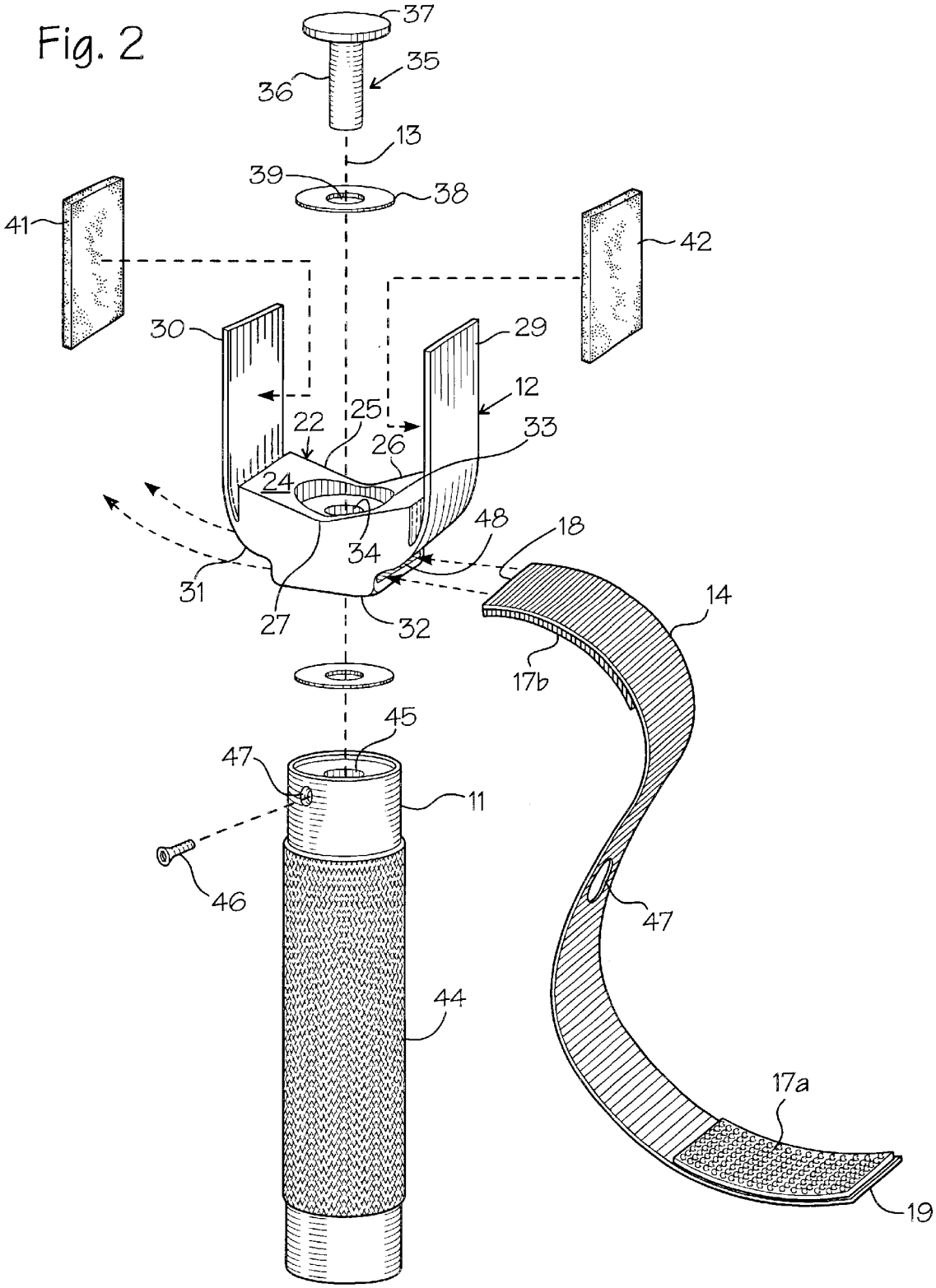
FIG. 2 illustrates an exploded perspective view of FIG. 1.

The U-shaped member 12, FIG. 2 has an elevated contoured member 22 mounted or formed into its curved portion. The elevated contoured member 22 extends upwardly within the confines of the U-shaped member 12. The contour member 22 is sized or contoured to receive a selected portion of the stock 16 mounted barrel 15, FIG. 5. The selected portion of the stock 16 mounted barrel 15 is derived from the comfort zone or relative length of user's 23 arms. The shorter the arm length of the user 23 the closer the present invention 10 is positioned to the trigger mechanism. Conversely, the longer the arm length of the user 23 the further the present invention 10 is positioned relative to the trigger mechanism.

The U-shaped member 12, FIG. 2 is formed from a pair of upright rectangularly shaped legs 29 and 30 adjoined to a curved portion 31. Parallel facing pads 41 and 42 are mounted onto the upright legs 30 and 29 respectively. The pads 41 and 42 support the barrel mounted stock portion of the firearm once the barrel mounted stock is inserted between the upright legs 30 and 29. The pads 41 and 42 may, if desired, be sized to equal the size of the upright legs 30 and 29 respectively. The material composition of the pads may be of any convenient type. Examples of pad materials are rubber, foam, plastic, metal, or polymer based materials. The thickness of the pads is selected to accommodate various dimensions of barrel mounted stocks. For example, barrel 15 mounted onto stock 16, FIG. 4 is inserted between the upright legs 29 and 30, FIG. 5. The pads 41 and 42 are sized to accommodate this particular barrel and stock configuration. Another example is barrel 43, FIG. 6 inserted between the upright legs 29 and 30, FIG. 7. The pads 41 and 42 are sized to accommodate this particular double barrel 43 configuration. The curved portion 31, FIG. 2 has an outwardly facing protuberance 32 or rectangular member 32 depending from the curved portion 31. The rectangular member 32 may, if desired, be equal in width to the upright legs 30 and 29. The rectangular member 32 has an aperture 48, FIG. 3 extending the width of the member. The aperture 48 is sized to receive the strap 14. The strap 14 has an aperture 47 disposed between its two oppositely spaced ends 18 and 19, The aperture 47 is sized to receive the swivelable member 35.

The U-shaped member 12, FIG. 2 has an aperture 33 centered between the upright legs 29 and 30 that extends from the top surface 24 through the elevated contoured member 22 and the rectangular member 32. The aperture 33 has a countersunk portion 34. The aperture 33 and countersunk portion 34 are sized to receive swivelable member 35. The U-shaped member 12 may, if desired, be fabricated from any convenient material. Examples of convenient materials are metal, plastic, wood, or polymer based materials.

The U-shaped member 12, FIG. 2 may, if desired, be fabricated from an injection mold or manufactured from subassemblies that comprise the total assembly. If the U-shaped member 12 is fabricated from an injection mold all of the subassemblies would have seamless joints. If the U-shaped member 12 is fabricated from piece parts the subassemblies would have joints that are abutted and secured together. For example, a first rectangular member has top and bottom surface. The top surface is formed into two mirror image sloping planes adjoined at a medial point relative to the two short sides of the first rectangular member thus forming a V-shaped top surface. The V-shaped top surface has its vertex adjacently spaced from the bottom surface. A second rectangular member has a top and bottom surface. The second rectangular member's top surface is mounted to the first rectangular member's bottom surface. The second rectangular member has an aperture traversing its longitudinal length. A pair of spaced apart upright elongated rectangular members each member having one end that is curved wherein each curved end is mounted to one of the short sides of the first rectangular member. The other ends of the upright elongated rectangular members each have a rectangularly shaped pad affixed thereto. The pads are parallel, oppositely facing, and spaced apart. The first elongated rectangular member has a first aperture centered about the vertex of the V-shaped top surface. The first aperture traverses the first and the second elongated rectangular members. The first aperture is sized to receive an elongated cylindrical member (discussed herein). The first elongated rectangular member has a countersunk aperture coaxially spaced to the first aperture. The countersunk aperture is sized to receive the cylindrical platform. Regardless of the fabrication techniques selected, the U-shaped member's functions are the same. The swivelable member 35 has an elongated cylindrical portion 36 that may, if desired, be sized to traverse aperture 33. The elongated cylindrical portion 36 has mounted at one end a cylindrical platform 37 that is centered about the centerline 13 of the elongated cylindrical portion 36. The cylindrical platform 37 may, if desired, be sized to swivelably engage the sidewalls of the countersunk portion 34. A washer or disk 38 has an aperture 39 in the center of the disk. The aperture 39 may, if desired, be sized to receive the elongated cylindrical portion 36. The disk 38 has a top and bottom surface that is frictionless. The top surface engages the bottom surface of the cylindrical platform 37 and the disk 38 bottom surface engages the top surface of the countersunk aperture 34. The top and bottom surface may, if desired, be impregnated with any substance that would enable the engaging surfaces to freely rotate once the disk is inserted into the present invention 10. An example of material that would enable the cylindrical platform 37 to freely rotate is Teflon®.

The elongated handle 11, FIG. 2 may, if desired, be cylindrically shaped with a hand-gripable surface 44. If desired, the hand-gripable surface 44 may be knurled to aid in gripping the present invention 10. The hand-gripable surface 44 may also be of any type of convenient material composition. Examples of hand-gripable materials are rubber, foam, plastic, metal, or polymer based materials. The handle 11 has an aperture 45 in one end. The aperture 45 is sized to receive the elongated cylindrical portion 36 of the swivelable member 35. Once the swivelable member 35 is inserted into the aperture 45, a setscrew 46 may, if desired, be inserted into a threaded aperture 47 and tightened to detachably secure the U-shaped member to the elongated handle 11.

The present invention 10, FIG. 4 is detachably secured to the barrel 15 mounted stock 16 portion of the firearm 20. The end portion of the stock 50 is pressed against the shoulder of the user 23. One of the user's 23 hands 51 is positioned in proximity to the firing mechanism 52. The user's 23 other hand 53 is positioned about the elongated handle 11 of the present invention 10.

The user 23, FIG. 4 may, if desired, sight or aim along the barrel 15 to the intended target (not shown). The user 23 while aiming the firearm 20 may, if desired, pivot the stock 50 causing the end of the barrel to arcuately traverse to the user's 23 front. The arcuate movement causes the U-shaped member 12, FIG. 3 to swivel while the user's 23 hand 53, FIG. 4 remains stationary about the elongated handle 11. The range of motion produced by the swivel action is from 60° (degrees) to about 165° (degrees). The range of motion is measured from either side of the firearm barrel 15 from the user's front right to front left. Preferably, the range of motion is from 70° (degrees) to about 155° (degrees). Conversely, the range of motion produced by the swivel action is from 165° (degrees) to about 60° (degrees). The range of motion is measured from either side of the firearm barrel 15 from the user's front left to front right. Preferably, the range of motion is from 155° (degrees) to about 70° (degrees).

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims, meansplus-function clause is intended to cover the structures described herein as performing the recited function and not only structural equivalents but also equivalent structures. Thus, although a nail and a screw may not be structural equivalents in that a nail employs a cylindrical surface to secure wooden parts together whereas a screw employs a helical surface, in the environment of fastening wooden parts, a nail and a screw may be equivalent structures.

We claim:

1. An apparatus for a firearm, the firearm having a user hand-gripable barrel portion, comprising:

a) a U-shaped member having an outwardly extending cylindrical protuberance swivelably disposed thereto;

b) an elevated contoured member formed to receive a selected portion of the user hand-gripable barrel portion, said elevated contoured member mountably disposed to said U-shaped member;

c) an elongated handle having an aperture disposed in one end, said aperture sized to receive said cylindrical protuberance;

d) said elongated handle being detachably secured to said cylindrical protuberance;

whereby the user gripping said elongated handle enables swivelable firearm movement.

2. An apparatus for a firearm as recited in claim 1 further comprising an elongated strap connectively disposed to said U-shaped member, said elongated strap traversing the user hand-gripable barrel portion of the firearm, said elongated strap detachably securing the firearm to said U-shaped member.

3. An apparatus for a firearm as recited in claim 2 wherein said elongated strap traversing the user hand-gripable barrel portion of the firearm comprises:

a) said U-shaped member having an aperture disposed on the curved portion thereof, said aperture sized to receive said strap;

b) said elongated strap having connectively disposed at one end one half of a hook and loop fastener, the other end of said strap having the other half of said hook and loop fastener;

c) said elongated strap having an aperture medially spaced to said elongated strap ends, said aperture sized to receive said cylindrical protuberance; and d) said elongated rectangular strap having one end detachably securable to the other end of said elongated strap via said hook and loop fastener.

4. An apparatus for a firearm as recited in claim 3 wherein said outwardly extending cylindrical protuberance comprises an elongated cylindrical member having disposed at one end a cylindrical platform.

5. An apparatus for a firearm as recited in claim 4 further comprising:

a) a first disk having an aperture disposed therein;

b) said aperture sized to receive said elongated cylindrical member; and c) said first disk's diameter sized to equal the diameter of said cylindrical platform.

6. An apparatus for a firearm as recited in claim 5 wherein said U-shaped member comprises:

a) An elevated curved member;

b) a pair of parallel spaced apart elongated rectangular upright members, said elongated upright members each having one curved end, said curved ends being mountably disposed to said elevated curved member; and c) a pair of parallel oppositely facing spaced apart pads mountably disposed to each said upright member.

7. An apparatus for a firearm as recited in claim 6 wherein said elevated contoured member comprises:

a) a rectangular portion having top and bottom surfaces, said top surface being two mirror image sloping planes adjoined at a medial point relative to the two short sides of said rectangle portion forming a V-shaped top surface;

b) said V-shaped top surface having its vertex adjacently spaced from said bottom surface; and c) said bottom surface and the adjacent short sides of said rectangular portion being sculptured into the curved portion of said U-shaped member.

8. An apparatus for a firearm as recited in claim 7 wherein said elongated handle being detachably secured to said U-shaped member comprises;

a) a threaded set-screw;

b) said elongated handle having a threaded aperture;

c) said threaded aperture sized to receive said threaded set-screw;

whereby inwardly rotating said threaded setscrew engages said cylindrical protuberance detachably securing said elongated cylindrical member to said elongated handle.

9. An apparatus for a firearm as recited in claim 8 further comprising:

a) a second disk having an aperture disposed therein, said aperture sized to receive said elongated cylindrical member; and b) said second disk mountably disposed between said U-shaped member and said elongated handle.

10. An apparatus for a firearm, the firearm having a hand gripable barrel portion, comprising:

a) an elongated cylindrical member having disposed at one end a cylindrical platform;

b) a first disk having an aperture disposed therein, said first aperture sized to receive said elongated cylindrical member, said first disk sized to equal the diameter of said cylindrical platform;

c) a first rectangular member having top and bottom surfaces, said top surface being two mirror image sloping planes adjoined at a medial point relative to the two short sides of said first rectangular member forming a V-shaped top surface, said V-shaped top surface having its vertex adjacently spaced from said bottom surface;

d) a second rectangular member having top and bottom surfaces, said second rectangular member's top surface adjoined to said first rectangular member's bottom surface, said second rectangular member having an aperture traversing its longitudinal length;

e) a pair of spaced apart upright elongated rectangular members, each said upright elongated rectangular member having one end curvedly disposed to one of the short sides of said first rectangular member, the other ends of said upright elongated rectangular members each having a rectangularly shaped pad affixed thereto said pads being parallel, oppositely facing and spaced apart;

f) said first and said second elongated rectangular members, having a first aperture centered about the vertex of said V-shaped top surface, said first aperture traversing said first and said second elongated rectangular members, said first aperture sized to receive said elongated cylindrical member;

g) said first elongated rectangular member having a countersunk aperture coaxially spaced to said first aperture, said countersunk aperture sized to receive said cylindrical platform;

h) an elongated cylindrical handle having a first end and a second end oppositely spaced from said first end, a slip resistant textured surface disposed about the surface of said elongated cylindrical handle;

i) said elongated cylindrical handle's first end having an aperture disposed therein, said elongated cylindrical handle's aperture sized to receive said elongated cylindrical member;

j) an elongated threaded set-screw;

k) said elongated cylindrical handle's first end having an adjacently spaced threaded aperture, said threaded aperture sized to receive said elongated threaded set-screw thereby inwardly rotating said threaded set-screw engages said elongated cylindrical member detachably securing said elongated cylindrical member to said elongated cylindrical handle;

l) an elongated rectangular strap traversing said second rectangular member's aperture;

m) said strap having connectively disposed at one end one half of a hook and loop fastener, the other end of said strap having the other half of said hook and loop fastener;

n) said elongated rectangular strap having one end detachably securable to the other end of elongated rectangular strap, said elongated rectangular strap having an aperture medially spaced to said elongated strap ends, said elongated rectangular strap's aperture sized to receive said elongated cylindrical member;

o) a second disk having an aperture disposed therein, said second disk's aperture sized to receive said elongated cylindrical member, said second disk's diameter sized to equal the diameter of said elongated handle's first end;

whereby positioning the hand gripable barrel portion of the firearm between said upright elongated rectangular members and detachably securing the barrel portion thereto with said elongated rectangular strap provides the user a hand gripable support of the firearm.

11. An apparatus for a firearm, the firearm having a user hand-gripable barrel portion, comprising:

a) a U-shaped member having an outwardly extending cylindrical protuberance swivelably disposed thereto;

b) said U-shaped member comprising a pair of upright rectangularly shaped legs adjoined to a curved portion;

c) a rotatable first disk annularly mounted about said outwardly extending cylindrical protuberance;

d) a contoured member, formed to receive a selected portion of said user hand-gripable barrel portion, said contoured member mountably disposed along said curved portion of said U-shaped member;

e) an elongated handle having an aperture disposed in one end, said aperture sized to receive said cylindrical protuberance;

f) a rotatable second disk annularly mounted about said outwardly extending cylindrical protuberance, said second disk disposed between said U-shaped member and said elongated handle;

g) said elongated handle being secured to said cylindrical protuberance by a set-screw;

h) an elongated rectangular strap;

i) said U-shaped member having an aperture disposed on said curved portion thereof, said aperture sized to receive said elongated rectangular strap;

j) said elongated rectangular strap having an aperture medially spaced to said elongated strap ends, said elongated rectangular strap's aperture sized to receive said cylindrical protuberance;

k) said elongated strap having connectively disposed at one end one half of a hook and loop fastener, the other end of said strap having the other half of said hook and loop fastener;

l) said elongated rectangular strap having one end detachably securable to the other end of said elongated strap thereby detachably securing the firearm to said U-shaped member;

whereby the user gripping said elongated handle enables swivelable firearm movement.

12. An apparatus for a firearm, the firearm having a user hand-gripable barrel portion, comprising:

a) an elongated cylindrical member having disposed at one end a cylindrically shaped platform;

b) a U-shaped member comprising a pair of upright spaced apart oppositely facing legs seamlessly adjoining a curved portion, said curved portion having an outwardly extending substantially rectangular bottom surface;

c) said U-shaped member sized to receive the hand-gripable barrel portion of the firearm;

d) a cylindrical wall forming a first aperture disposed along said U-shaped member's curved portion, said cylindrical wall having one end counter-sunk;

e) said elongated cylindrical member slidably insertable into said U-shaped member's aperture, said elongated cylindrical member contiguous to said cylindrical wall, said cylindrically shaped platform contiguous to said cylindrical wall's counter-sunk end, said elongated cylindrical member outwardly extending from said curved portion's substantially rectangular bottom surface;

f) an elongated handle having one end formed into a substantially circular platform, said circular platform having an aperture sized to receive said elongated cylindrical member; said circular platform engaging said curved portion's substantially rectangular bottom surface;

g) said elongated cylindrical member being detachably secured to said handle;

whereby said elongated cylindrical member remains stationary with respect to said handle and said U-shaped member swivels about said elongated cylindrical member.

* * * * *